United States Patent [19]

Spurgin

[11] 4,120,258

[45] Oct. 17, 1978

[54] VARIABLE RATIO HELM

[75] Inventor: William T. Spurgin, Charlottesville, Va.

[73] Assignee: Sperry Rand Corporation, New York, N.Y.

[21] Appl. No.: 731,614

[22] Filed: Oct. 13, 1976

[51] Int. Cl.[2] ..... B63H 25/00

[52] U.S. Cl. ..... 114/144 E; 115/35

[58] Field of Search ..... 318/588, 563, 565, 597, 318/620, 626; 244/50, 83 G, 83 H, 175, 178, 179, 194; 180/79.1; 91/361, 362; 115/35, 18 R, 18 E; 114/144 R, 144 E, 144 A, 154, 159, 160, 161

[56] References Cited

U.S. PATENT DOCUMENTS

| | | | |
|---|---|---|---|
| 1,128,661 | 2/1915 | Clay | 114/154 |
| 2,667,939 | 2/1954 | Purkey | 114/144 R |
| 2,971,489 | 2/1961 | Loser | 114/154 |
| 3,208,300 | 9/1965 | Morse | 114/144 RM |
| 3,249,080 | 5/1966 | McBrayer | 114/144 E |
| 3,331,350 | 7/1967 | Norton | 115/18 R |
| 3,390,614 | 7/1968 | Tatum | 114/144 E |
| 3,485,463 | 12/1969 | Miller | 244/178 |
| 3,527,186 | 8/1970 | Wennberg | 114/144 E |
| 3,528,633 | 9/1970 | Knemeyer | 244/179 |
| 3,823,617 | 7/1974 | Infanger | 114/154 |
| 3,919,961 | 11/1975 | McDougal | 114/144 E |
| 3,949,696 | 4/1976 | Onishi | 318/588 |

*Primary Examiner*—Trygve M. Blix
*Assistant Examiner*—D. W. Keen
*Attorney, Agent, or Firm*—Howard P. Terry; Albert P. Cefalo

[57] ABSTRACT

An illustrative embodiment of the invention provides a ship's steering system or helm adapted to provide a control signal to the ship's rudder such that the response of the rudder to the rotation of the helm is substantially non-linear from hardover to hardover wherein a portion centered about midship is linear such that hardover to hardover rudder can be ordered in less than one turn of the wheel. That is, less rotation of the wheel is necessary when large helm or rudder orders are required for heading changes and a greater rotation of the wheel about midships is necessary to desensitize rudder changes to large wheel rotations in order to make heading keeping easier.

5 Claims, 8 Drawing Figures

VARIABLE RATIO HELM

BACKGROUND OF THE INVENTION

1. Field of the Invention

This invention relates to ships' steering systems or helms and, more particularly, relates to a variable ratio helm in which the ratio of rudder rotation to helm rotation is non-linear.

2. Description of the Prior Art

Traditionally a ship's steering system or helm has required a plurality of complete (360°) rotations of the helm's wheel to effect the hardover rudder rotation, i.e., a full rudder rotation of about 45°. This insensitivity of rudder rotation or movement to helm wheel rotation is an effect which grew out of the mechanical advantage of block and tackle coupling of the helm to the rudder which permitted a seaman to effectively generate enough force at the helm to effect a change of heading of a large ship by substantial displacement of the rudder, which is subjected to extremely large fluid forces. This insensitivity of rudder rotation to helm rotation, however, made heading keeping, that is, maintaining the ship aligned on course, much easier because large helm rotations, as large as 60°, in either direction resulted in minor repositioning of the rudder that is on the order of 5° in either direction and accordingly, less stringent control of the helm was required to keep the ship on course. It is to be noted that hardover rudder varies from ship to ship but is on the order of 45° rudder rotation from midship. Accordingly, as various mechanical and electrical systems eventually replaced the manual-pulley power arrangement for operation of the rudder, the insensitivity of the rudder to helm rotation remained, i.e., a plurality of helm rotations for hardover to hardover rudder, in order that rudder rotation during heading keeping remained insensitive to large wheel rotations as in the previous known pulley arrangements. However, for change of heading the insensitivity of the rudder to the rotation of the ship's steering system required a plurality, generally about three complete rotations of the helm from hardover to hardover rudder which can be a troublesome maneuver and which in an emergency situation requires additional time to order. Furthermore, during an emergency situation the seaman at the helm would order a hardover rudder, which as stated above, takes some time to rotate the wheel to this position, and if no response was forthcoming would then have to generate an emergency or Non Follow Up (NFU) operation to rotate the rudder in the required direction.

Therefore, there is a need to provide a helm which is insensitive to large rotations about midships for heading keeping and, also, highly responsive to helm rotation for change of heading. Furthermore, in this respect, during an emergency situation the instinctive reaction of the seaman at the helm to continue turning the wheel towards and past the hardover rudder position dictates a need to provide an emergency Non Follow Up system incorporated in the helm order device at the hardover rudder position.

SUMMARY OF THE INVENTION

In accordance with the invention, a ship's steering system or helm is provided which is capable of ordering hardover to hardover rudder in less than one complete rotation (360°) of the wheel and, in addition, provides a relatively insensitive signal about midships to the rudder such that a much greater wheel rotation for each degree of rudder rotation about midships is required in order to make heading keeping easier.

Specifically, a variable ratio ship's helm according to this invention includes a desensitized control about midships such that for a sector of the wheel rotation fine hand control is possible which prevents "over steering" about a desired heading. Furthermore, the variable ratio ship's helm also includes a more responsive control for the remaining sector of the wheel rotation which requires less wheel rotation for each degree of rudder rotation such that large helm or rudder orders for changing ship's heading, between the range of hardover to hardover rudder, are possible in less than one revolution of the helm.

More specifically, the variable ratio ship's steering system or helm of this invention includes variable signal means, such as a variable ratio potentiometer, for converting movement of the helm into a variable ratio helm order signal to the rudder. In particular, the preferred embodiment of the variable ratio helm of this invention comprises a non-linear potentiometer coupled to the wheel which provides a helm output signal which is linear in the region from 5° left rudder to 5° right rudder, in which the helm has a gradient of approximately 9° of helm per degree of rudder, and which is logarithmic thereafter, so that about 150° of helm (left or right) is equal to about 45° hardover rudder (left or right) respectively. The helm of this invention also includes adjustable stops to provide various hardover rudder settings, other than 45°, corresponding to the hardover rudder setting of the particular ship; centering means for returning the helm to midships; helm adjustment means for providing an offset rudder angle, other than midships, for heading keeping; and overriding emergency steering or non followup control selectable at both hardover rudder positions, which directly applies power to the rudder in the appropriate direction.

The various features of novelty which characterize the invention are pointed out with particularity in the claims annexed to and forming a part of this specification. For a better understanding of the invention, its operating advantages and specific objects obtained by its use, reference should be had to the accompanying drawings and descriptive matter in which there is illustrated and described a preferred embodiment of the invention.

DETAILED DESCRIPTION OF THE PREFERRED EMBODIMENTS

For a more complete appreciation of the invention, attention is invited to the following description of an illustrative embodiment of the invention, as shown in the attached drawings.

Figure 1:
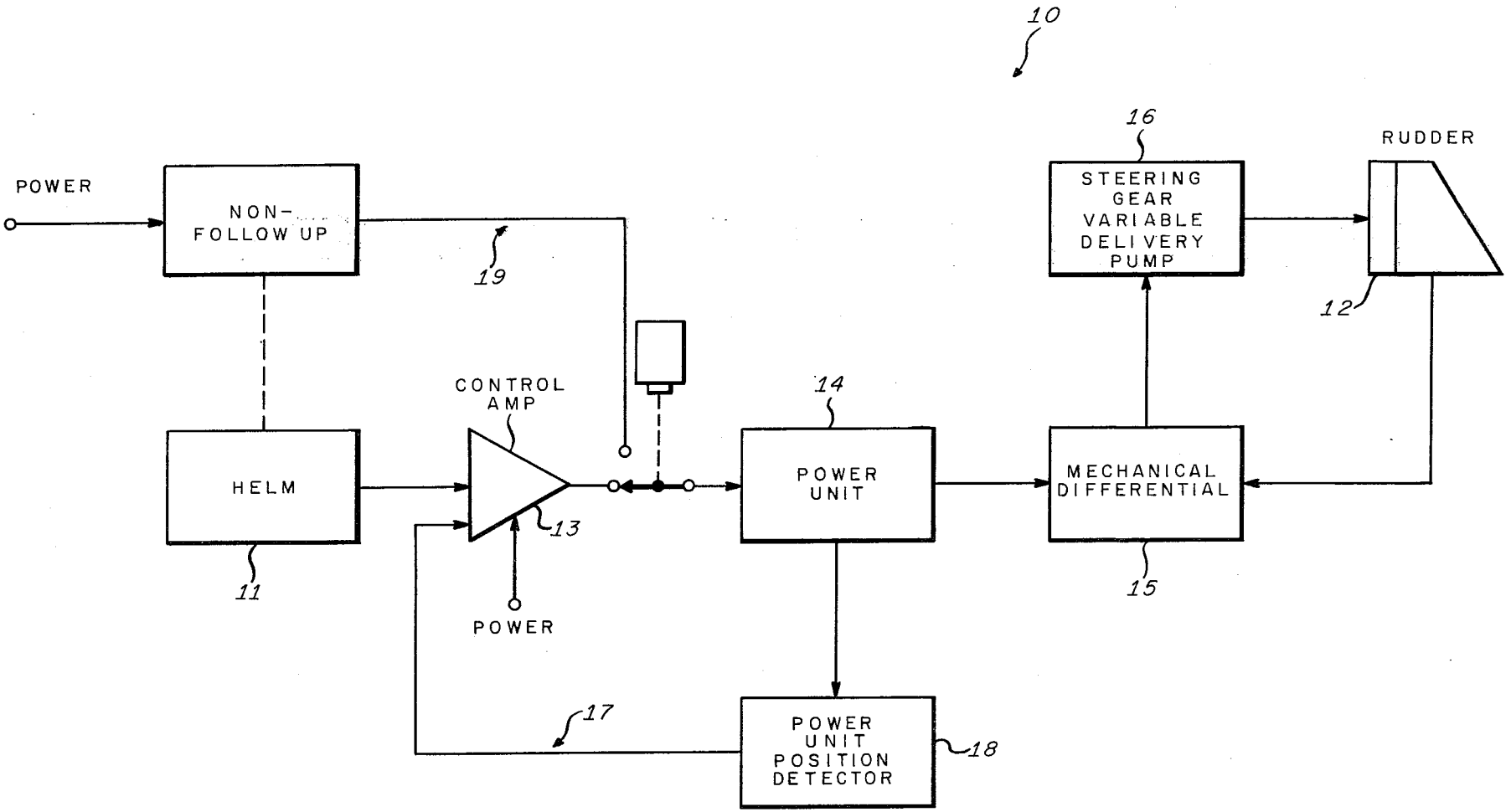
FIG. 1 is a block diagram illustrating the helm-rudder electrical connection and the helm-non followup-rudder connection of this invention.

Illustrated in FIG. 1 is a block diagram showing the helm-rudder electrical connection 10 for a typical ship's steering system. The helm-rudder connection 10 includes a helm 11 whose signal is applied to the rudder 12 through a control amplifier 13, a power unit 14, mechanical differential 15, steering gear 16 and a repeat-back loop 17 having a power unit position detector 18 coupled between the power unit 14 and the amplifier 13 for a feedback of the power unit position thereto. Also indicated in FIG. 1 is a non-followup circuit 19 which is connected to the helm 11 of this invention to be hereinafter described.

Figure 2:
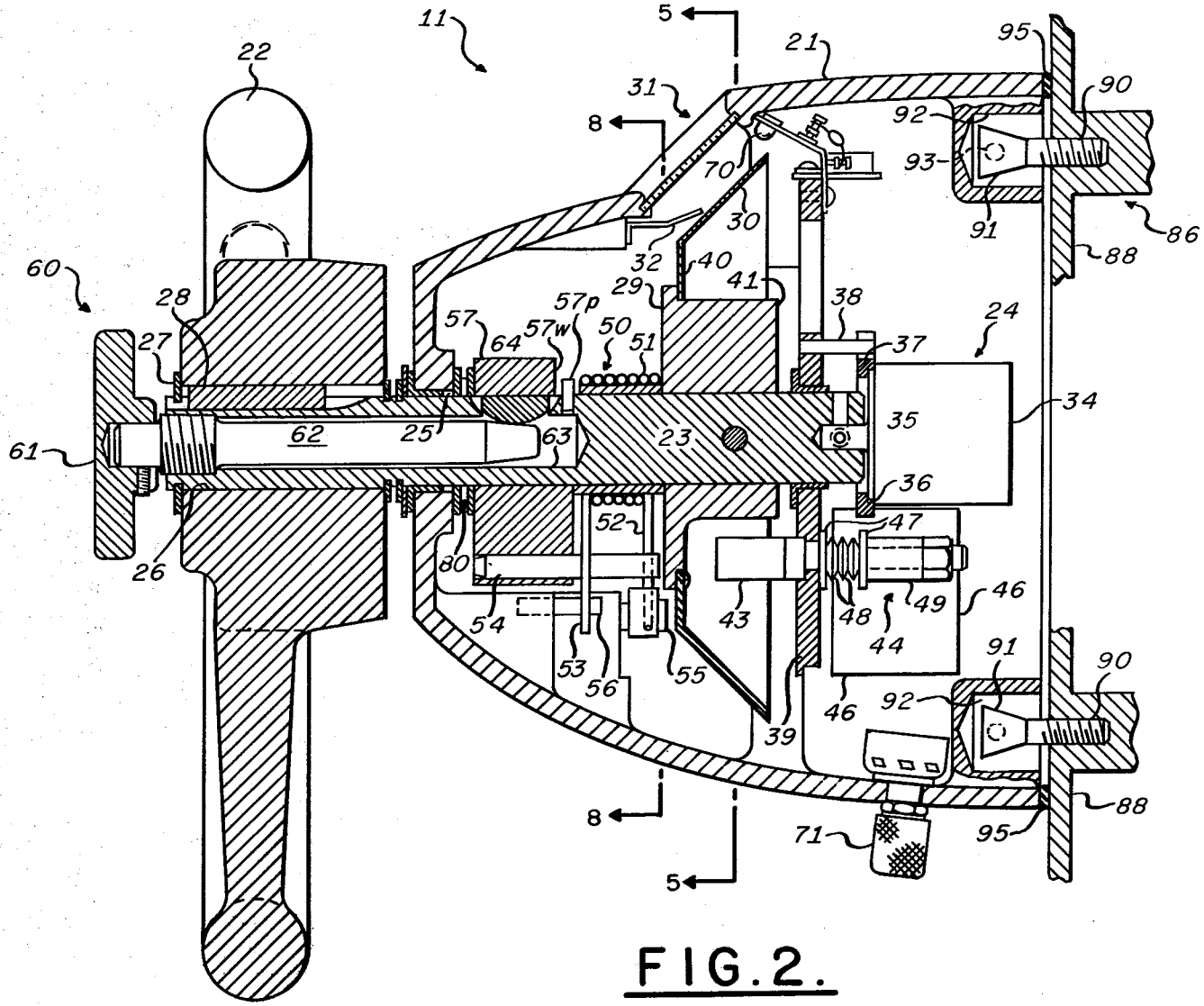
FIG. 2 is a side view in section of a ship's steering system or helm that embodies principles of the invention.
Figure 3:
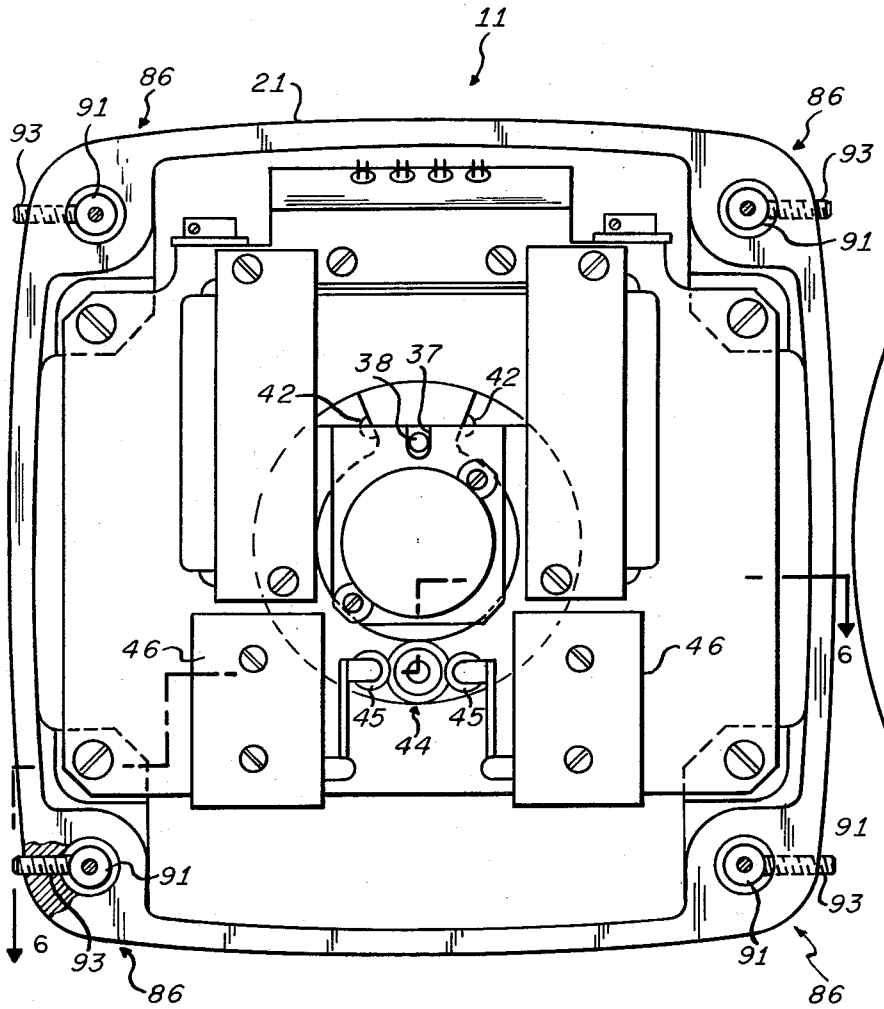
FIG. 3 is a rear view of FIG. 2.

The ship's steering system or helm 11 according to this invention is shown in FIG. 2, and comprises a housing 21, a wheel 22, and a shaft 23 interconnecting the wheel 22 to a compound signal generating means 24 disposed within the housing 21. The shaft 23 extends through a bore 25 in the housing and a bore 26 in the wheel and incorporates retaining rings 27 and a key 28 for the purpose of positioning and holding the shaft in the wheel as is commonly known to those skilled in the art. Attached to the shaft 23 and rotatable therewith via an irregular shaped disc 29 is a dial 30 for indicating helm order angle as seen through an opening 31 in the housing 21 and as indicated by a pointer or indicator 32 attached to the housing. In the preferred embodiment of this invention, the compound signal generating means 24 comprises a non-linear potentiometer 34 including rotating means 35 coupled to the shaft 23 for providing a signal output to the rudder 12. Furthermore, as shown in FIGS. 2 and 3, the potentiometer 34 is attached to a plate 36 having a slot 37 therein adapted to receive a pin 38 which is secured to a plate 39 attached to the housing 21, to enable rotation of the rotating means 35 with the wheel 22 while preventing rotation of the potentiometer 34. In the preferred embodiment of this invention, moreover, the non-linear potentiometer 34 provides a linear signal to the rudder corresponding to 1° of rudder rotation for every 9° of a first portion of wheel 22 rotation from a null point 0° or midships to 5° of rudder in 1° increments, for both left and right rudder, as shown on the matching curve on the dial 30 as viewed in FIG. 4. Furthermore, for 5° rudder to hardover rudder, about 45°, the output signal from the potentiometer 34 to the rudder varies logarithmically with the rotation of the wheel 22. That is, rotation of the rudder from midships or 0° (in either direction) to 5° rudder is accomplished in 45° of wheel 22 rotation in a corrresponding direction, and rudder rotation from 5° to hardover rudder or about 45° rudder, is accomplished in the remaining 105° of wheel rotation for the desired direction. Thus, in the preferred embodiment of this invention, hardover rudder is accomplished in about 150° of wheel rotation, that is, less than one-half of a complete revolution of wheel rotation from midships to hardover rudder and less than one complete revolution of wheel rotation for hardover rudder to hardover rudder.

Figure 4:
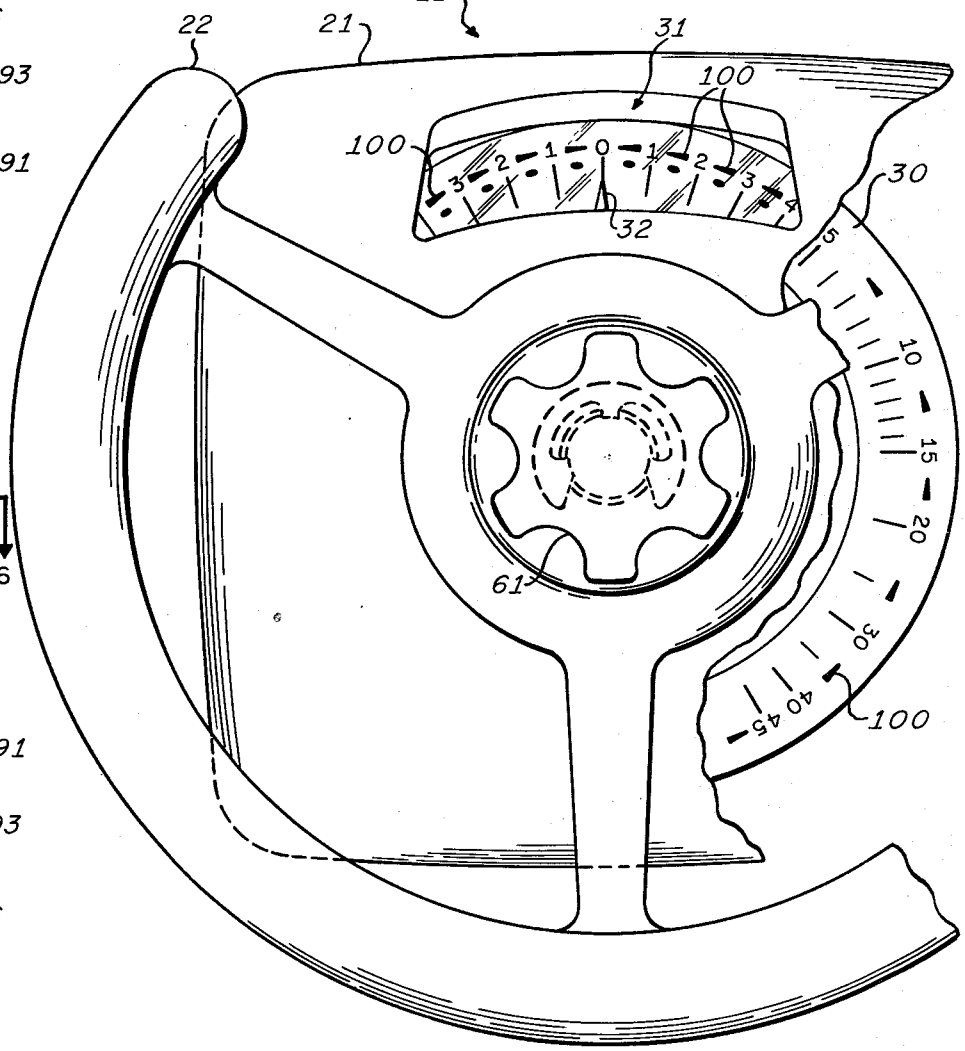
FIG. 4 is a front view of FIG. 2 partially in section showing the helm's dial.
Figure 5:
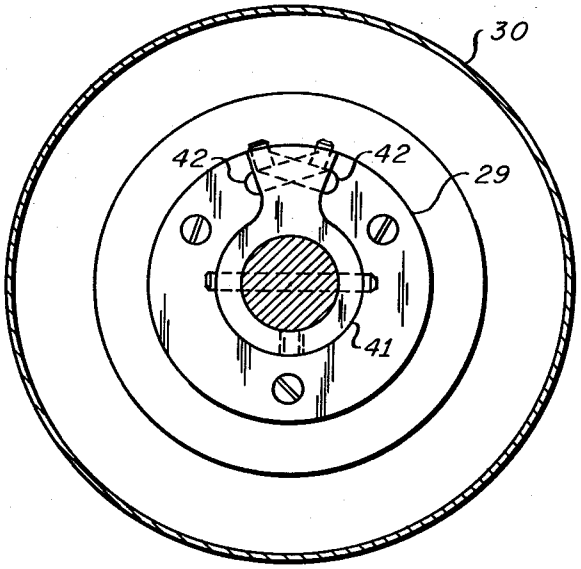
FIG. 5 is a view of a portion of this invention looking in the direction of 5—5 of FIG. 2.

Referring now to FIGS. 2, 4 and 5, the dial 30 is shaped in the form of a truncated cone having a lip portion 40 extending radially inwardly towards the irregular shaped disc 29 and fastened thereto. The face of the dial 30 is shown in FIG. 4 having numerals disposed thereon for indication of rudder angle. As shown, the numerals extend linearly from a null point, marked 0°, to 5° and thereafter extend logarithmically to 45° hardover rudder for both left and right rudder, as explained above.

Figure 7:
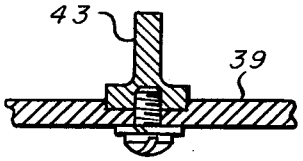
FIG. 7 is the hardover rudder position stop of the helm of this invention without the emergency steering system switch shown in FIG. 6.
Figure 6:
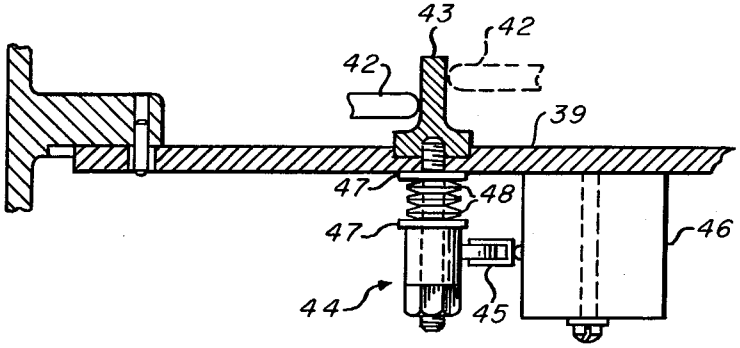
FIG. 6 is a view of the switch which couples the non followup emergency steering system to the helm of this invention at the hardover rudder position as shown in 6—6 of FIG. 3.

The irregular shaped disc 29 (FIG. 2) includes a cylindrically flared portion 41 (FIG. 2 and FIG. 5) extending axially of the shaft 23 which includes adjustable stop members 42, FIG. 5, which may also include pin members to insure the desired position or location of the adjustable stops. The adjustable stops 42 are set at the desired hardover rudder angle position specified by the particular ship to which the helm 11 of this invention is to be adapted. Rotation of the wheel 22 rotates the irregular shaped disc 29 and the accompanying adjustable stops 42, one of which, at the hardover rudder position, left or right, strikes a T-shaped pin member 43 attached to the plate 39 extending axially outwardly therefrom, see FIGS. 2, 6 and 7. In one embodiment, FIG. 7, the T-shaped member 43 is the hardover rudder "stop" which the adjustable stops 42 engage at the hardover rudder position and which prevent further rotation of the wheel 22 in the appropriate direction. In the preferred embodiment of this invention, however, as seen in FIG. 6, wherein both adjustable stops 42 are shown in their respective hardover position, the T-shaped member 43 forms part of a switching means 44 which extend axially outwardly from the opposite side of the plate 39 (FIG. 3 and FIG. 6) and is connected by actuator 45, only one being shown in FIG. 6, to one of a pair of microswitches 46. The microswitch 46, when tripped, activates the non followup circuit 19, FIG. 1, for applying power directly to the rudder 12 in the corresponding direction ordered by the wheel 22 of the helm 11. In this manner, if hardover rudder is reached and no response of the rudder is experienced, the emergency non followup circuit 19 may be immediately and instinctively activated, by the application of an additional turning force to the wheel 22 of the helm 11 which trips the switching means 44 and trips the corresponding microswitch 46.

The switching means 44 comprises a threaded stud attached to T-shaped member 43, a pair of washers 47, belleville or spring washers 48 disposed between the washers 47, spacer means 49 and a nut for holding the washers and spacers to the stud. The belleville washers or spring washers 48 compress under an applied force such as an additional force or torque applied to the helm 11 which, in turn, is transmitted from the appropriate adjustable stop 42 to its corresponding T-shaped member 43, such that the switching means 44 tilts into engagement with the appropriate actuator 45 actuating the appropriate microswitch 46 and the non followup circuit 19. It is noted that, in the embodiment shown in FIG. 7, T-shaped member 43 fixedly attached to plate 39 will resist any additional force or torque from the helm 11 which attempts to rotate the rudder further than the hardover position dictated by the ship and allocated by the adjustable stops 42 and T-shaped member 43.

Figure 8:
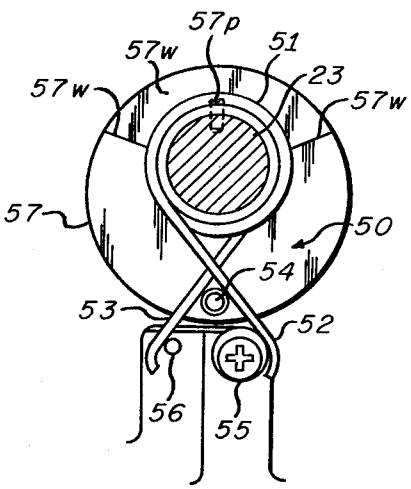
FIG. 8 is a view of the spring centering means of this invention as shown in the direction of 8—8 of FIG. 2.

A further embodiment of the invention is also disclosed in FIGS. 2, 4 and 8 in which a spring return 50 is coupled via the shaft 23 to the wheel 22 and the housing 21. The spring return 50 comprises a coiled spring 51 having opposite leg portions 52 and 53 coupled to the shaft 23 by means of a pin 54 which may be fixedly attached to the shaft 23 but is shown in this preferred embodiment attached to a disc 57 cpupled to the shaft 23 as described below. The opposite leg portions 52 and 53, which are axially spaced from each other, cross one another (as shown in FIG. 8) and removably engage a stop 55 and 56, respectively fixedly attached to the housing 21 and the pin 54, which is shown in this embodiment attached to a disc 57 encircling the shaft 23. The stop pin 55 is eccentric and may be adjusted to remove lost motion of the spring return device 50. The pin 54, moreover, engages the legs 52 and 53 such that movement of the wheel 22 in either direction (right or left) engages one of the opposite legs (52 or 53) respectively, the other leg being fixedly engaged by its stop (56 or 55) respectively, and deflects the spring 51 by rotation thereof such that upon release of the force or torque affecting the movement of the wheel the deflected spring 51 engages the pin 54, returning the wheel 22 and dial 30 to midships or the "0" position which appropriately signals the rudder to return to the midship position. Also incorporated in this embodiment of the invention is a "Weather Helm" adjustment 60 (FIG. 2) which may be used to establish a new "0" position for the rudder, i.e., rudder offset or bias, to compensate for any long time moments caused by wind, sea and hydrodynamic forces, which may be affecting the heading of the ship. The "Weather Helm" adjustment 60 includes a knob 61 coupled to the dial 30 and the shaft 23 via an adjustment shaft 62 which extends into a bore 63 in the shaft 23. The "Weather Helm" adjustment 60 further includes a plurality of frictionally engaging key like members 64 (one of which is shown) disposed in the shaft 23 and extending into the bore 63 such that they are engaged by the adjustment shaft 62 upon appropriate rotation of the knob 61 inserting the shaft 62 into the bore 63. The engagement of the adjustment shaft 62 with the key like members 64 forces them into frictional, clutching, engagement with the disc 57 such that disc 57 is adustably attached to the shaft 23. Rotation of the knob 61 in an opposite direction backs off the adjustable shaft 62 from the position shown in FIG. 2 which releases the key like members 64 and declutches the disc 57 such that the wheel 22 may be turned to an alternate rudder position or offset angle, to compensate for the deviation forces affecting the heading of the ship, without deflecting the spring return 50. Accordingly, upon a counter rotation of the adjustment 60 and engagement of the key like members 64 to disc 57 a new zero-torque position is established at the selected offset angle, this is, at the new zero-torque position of the spring return 50. Thus, the spring return 50 will return the wheel upon release thereof from a heading to the new zero-torque selected offset angle. It is noted in FIGS. 2 and 8 that disc 57 may be formed having a wedge shape 57*w* therein in which is situated a pin 57*p* attached to the shaft 23. The pin 57*p* limits the setting of the new zero-torque position to an angle no greater than the half angle of the wedge shape 57*w*, if the pin 57*p* is disposed at the zero-torque-null position of the spring return 50 and the dial 30.

Further embodiments of the invention include a light 70 adjustable by a dimmer knob 71, FIG. 2, for illumination of the dial and a friction device 80, FIG. 2, or drag or braking means, such as a spring washer to prevent free wheeling of the shaft. The friction device 80 provides the necessary restraint, that is force or torque feedback, to the helmsman to enable him to accurately position and hold the helm steady. In addition, helm 11 of this invention includes mounting means 86 (FIG. 2) for securing the helm 11 to a console panel 88 by means of mounting studs 90 having an inverted conical head 91 which fits into a recess 92 located at the rear of the housing 21. The studs 90 are securely fastened to the console 88 and extend axially therefrom, and the helm 11 is fastened to the studs 90 by set screws 93 (FIG. 3) which enter the recess 92 from the sides of the housing 21 and substantially radially to the studs and tightly engage the conical heads 91 such that a wedging action therebetween forces the housing 21 and its associated gasket 95 into locking and sealing engagement with the console panel 88. Accordingly, the mounting means 86 provides a clean, neat, modern appearance and accommodates all console panel thicknesses or materials capable of supporting the helm 11 and provides "front removal" for ease of servicing of the helm.

In operation, rotation of the helm 11 or, more specifically, the wheel 22 is converted to a non-linear signal from hardover to hardover rudder by signal generating means 24 such that for 9° rotational increments of the wheel 22, in either direction (left or right rudder), the rudder will linearly displace in 1° increments accordingly, and for a wheel 22 rotation beyond the 5° rudder position to hardover rudder, in either direction, the rudder will rotate to an angle in anti-logarithmic proportion to the rotation angle of the wheel. That is, rotation of the wheel from 45° as measured from the null or midships position to 150° will rotate the rudder from 5° to 45° rudder or hardover rudder in logarithmic proportion to the wheel rotation. Thus, fine control in the "null" or central region and hardover-to-hardover rudder control requires less than one full turn of the wheel, which allows use of an aircraft type wheel 22 (FIG. 9). The aircraft type wheel, moreover, provides a visual indication of helm order. Furthermore, if for some reason, the rudder fails to respond to the rotation of the helm as the helmsman orders rudder rotation there is engendered a natural instinct in the helmsman to turn the wheel further in the appropriate direction and to hardover rudder and further if no response is forthcoming. Sufficient force or torque at the hardover stop condition due to a "panic" type reaction, however, will trip or close the switching means 44 and activate the microswitch 46 which energizes the emergency system or non followup circuit 19 such that rudder rotation is ordered at maximum rudder speed until the non followup loop is disconnected, for example, by releasing the force on the wheel opening the switch 44 which deactivates the non followup circuit.

It is noted that the dial 30 as shown in FIG. 4 includes direction indicators 100, formed in the shape of an arrow head or a plan view of a ship, disposed thereon in relative relation to the angular position indicating numerals. Further, the direction indicators 100 are presented in two sets, one set of which is arranged heading right to left (counterclockwise) and the other set is arranged heading left to right (clockwise). The direction indicators 100 present a visual indication to the helmsman of the direction of the ship's heading, the rudder angle thereof being indicated by the numeral indicated by the fixed point at 32, because the dial 30 of the instant helm 11 rotates with the shaft 23, as compared to a fixed dial in a rotating pointer in the prior art. Accordingly, a helmsman accustomed to the dial of the prior art could be confused by the dial 30 of this instant helm if the direction indicators 100 were not arranged as shown.

While the invention has been described in its preferred embodiments, it is to be understood that the words which have been used are words of description rather than limitation and that changes may be made within the purview of the appended claims without departing from the true scope and spirit of the invention in its broader aspects.

I claim:

1. An improved variable rate ship's helm for controlling the ship's rudder position, from one hardover position to a second hardover position through rotational displacement of the ship's steering means, from one hardover to another hardover stop position disposed less than 360° about the steering means, wherein the improvement comprises a non-linear potentiometer responsive to the displacement of said steering means and coupled to the ship's rudder, said non-linear potentiometer so constructed and arranged for producing an electrical signal which is linearly related to a first portion of the displacement of said steering means between fixed limits, centered about midships, of the steering means and associated potentiometer displacement, and which is non-linearly related to the remaining portion of the displacement of said steering means and associated potentiometer from each of said fixed limits to said respective hardover stop positions, the linear or non-linear electrical signal varying the ship's rudder position in a linear or non-linear manner, respectively.

2. A ship's helm according to claim 1 wherein said potentiometer produces a signal which is anti-logarithmic with respect to the remaining portion of said steering means displacement.

3. A ship's helm according to claim 1 further including spring return means for returning the displaced steering means to its null position.

4. A ship's helm according to claim 3 wherein said spring return means includes frictional clutch means responsive to said steering means and disengageably attached to said steering means whereby upon disengagement of said frictional clutching means the null position of said steering means may be altered.

5. A ship's helm according to claim 1 for mounting on a panel, including mounting means, wherein said mounting means comprises mounting studs having an inverted conical head portion, the mounting studs being securely fastened to the panel extend longitudinally outward therefrom, and having their inverted conical head disposed in the recess within said helm, and set screws which enter the recess radially to said mounting studs and wedgingly engage said conical head for securely holding said helm to said panel.

* * * * *